US008067706B2

(12) United States Patent
Tukachinsky

(10) Patent No.: US 8,067,706 B2
(45) Date of Patent: Nov. 29, 2011

(54) TIMER FOR OPERATING ELECTRIC APPLIANCES AT SATURDAY AND HOLYDAY ACCORDING TO JEWISH RELIGIOUS LAW

(76) Inventor: Ezra Gmul Tukachinsky, Haifa (IL)

( * ) Notice: Subject to any disclaimer, the term of this patent is extended or adjusted under 35 U.S.C. 154(b) by 941 days.

(21) Appl. No.: 11/894,299

(22) Filed: Aug. 22, 2007

(65) Prior Publication Data

US 2009/0050458 A1 Feb. 26, 2009

(51) Int. Cl.
*H01H 19/00* (2006.01)

(52) U.S. Cl. ..... 200/19.15

(58) Field of Classification Search ..... 200/38 FA, 200/19.15, 43.01; 368/108; 219/492, 412, 219/494, 506
See application file for complete search history.

(56) References Cited

U.S. PATENT DOCUMENTS

| | | | | |
|---|---|---|---|---|
| 3,610,753 | A * | 10/1971 | Neubauer | 368/108 |
| 3,930,359 | A * | 1/1976 | Flumm et al. | 200/38 FA |
| 4,198,576 | A * | 4/1980 | Staton | 307/141.8 |
| 5,808,278 | A * | 9/1998 | Moon et al. | 219/506 |
| 6,066,837 | A * | 5/2000 | McCormick et al. | 219/702 |
| 6,703,591 | B2 * | 3/2004 | Daum et al. | 219/506 |

* cited by examiner

*Primary Examiner* — Edwin A. Leon

(57) ABSTRACT

A control device (timer) enabling activation of electric appliances for a required time period at Saturday and Holyday within the frame of Jewish religious law is disclosed. The timer comprises a first timing device, activating the appliance from time to time for a short period, and then deactivating it, and a second timing device, which, when activated manually or at any other way, delays the appliance deactivation by the first timing device for a required time period, and so makes the appliance usable for this period, beginning from the nearest initiation thereof by the first timing device. The timer can be a stand alone device or built into the appliance.

12 Claims, 4 Drawing Sheets

TIMER FOR OPERATING ELECTRIC APPLIANCES AT SATURDAY AND HOLYDAY ACCORDING TO JEWISH RELIGIOUS LAW

FIELD OF THE INVENTION

This invention relates to timers for operating electric appliances at Saturday and Holyday according to Jewish religious law, both stand alone and built into the appliances.

BACKGROUND OF THE INVENTION

In Jewish religious law, there are limitations for using electricity at Saturday and Holyday. Manual switching on and off is forbidden. Automatic switching electric appliance on and off at times programmed before beginning Saturday or Holyday is allowed. A timer is known, called "Saturday watch", which enables such kind of programming. It is used, for example, for operating heating appliances at Saturday or cooking ovens at Holyday. In fact, any programmable timer is suitable for this. The problem with it is inflexibility, when the heater is activated independently on the weather, and the oven at pre-defined times only.

The Jewish law allows also manual actions, which delay switching on or off, but do not cancel it. So, opening door of a refrigerator, when the motor is active, delays the motor switching off and is allowed.

The difference between Saturday and Holyday is which appliances can be used, and not how to operate them, so, we will use here "Saturday" term for both of them.

It would clearly be beneficial to provide for a control device enabling manual operating electric appliances when needed within the frame of the law. The timer of the invention does it via allowable delay of the switch off action.

SUMMARY OF THE INVENTION

It is an object of the invention to provide a control device which allows manual operating electric appliances at Saturday and Holyday within the frame of Jewish religious law.

The invention achieves this by periodic activating the appliance for a short time period and allowable delay of deactivating it when needed.

In accordance with the first aspect of the invention, there is provided a timer for operating electric appliances at Saturday and Holyday in accordance to Jewish law, activating the appliance and deactivating it, the timer comprising:

a first timing device, activating and deactivating the appliance from time to time, and a second timing device, which, when activated, delays the appliance deactivation by the first timing device.

According to a second aspect of the invention, there is provided an electric appliance, comprising the timer according to the first aspect of the invention built in. In addition to this timer, which is a Saturday operating device, the appliance can include a secular operating device and a switch for selecting one of these operation modes. Some parts, like a mechanical timer, can be common for both operating devices.

With the timer in form of a stand-alone device, the timer must be initiated and an appliance connected to it before Saturday begins. With the appliance having the timer built in, the Saturday operation mode must be initiated before Saturday.

BRIEF DESCRIPTION OF THE DRAWINGS

In order to understand the invention and to see how it may be carried out in practice, some preferred embodiments will now be described, by way of non-limiting examples only, with reference to the accompanying drawings, in which.

In all figures, similar components are identified by identical reference numerals.

DETAILED DESCRIPTION OF PREFERRED EMBODIMENTS

Figure 1:
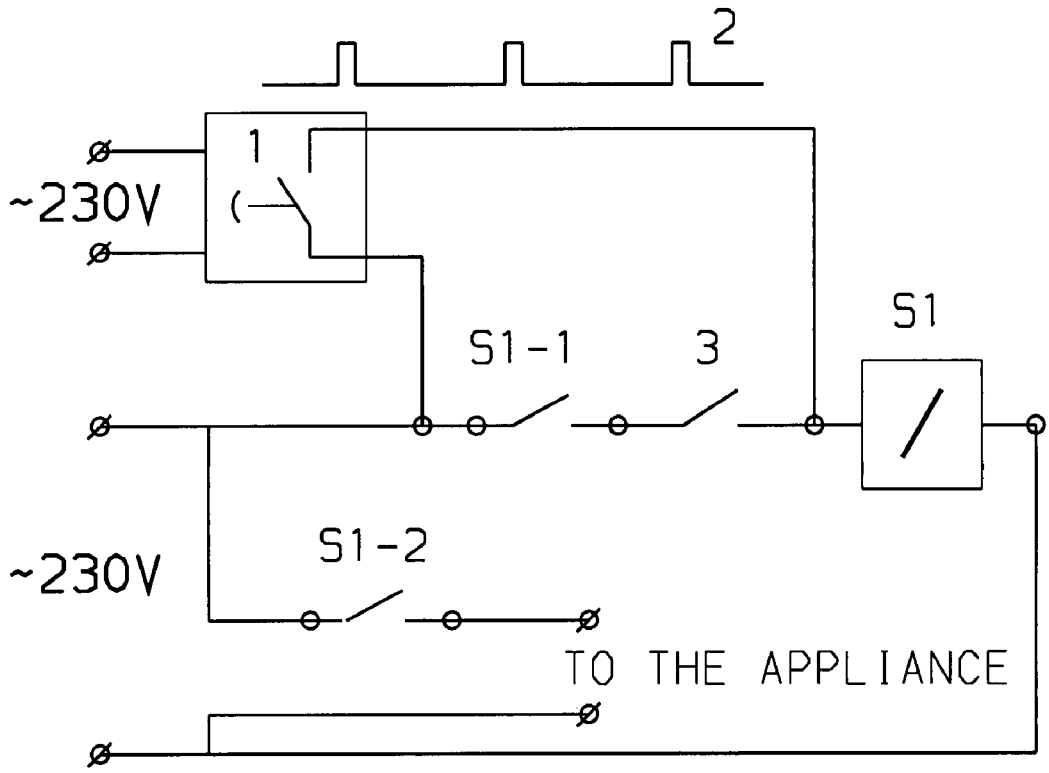
FIG. 1 is an electric scheme of the timer of the invention, activating the appliance at pre-defined times.
Figure 2:
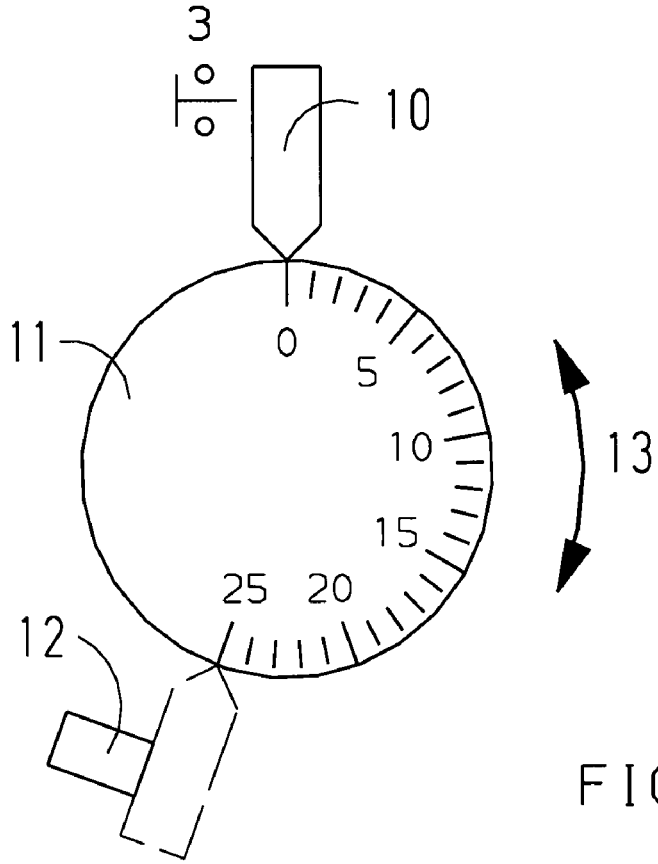
FIG. 2 is a schematic view showing a mechanical timing device of the timer shown in FIG. 1.

FIG. 1 shows an electric scheme of the timer according to the invention. The timer connects and disconnects an electric appliance (not shown) to the electric grid. Electromechanical or electronic timing device 1 closes its contacts at pre-defined times for a short time periods (see graph 2). A relay S1 has two normally opened pairs of contacts, S1-1 and S1-2. The switch 3 is of a mechanical timer 11 (see FIG. 2), open when the timer 11 is not activated (the handle 10 at the "0" of the time scale). The timer 11 can be activated by manual turning its handle 10 clockwise 13 to a required time interval at the time scale. Its reverse stroke (13 counterclockwise), which is time counting, is performed by a spring-driven mechanism or by an electric motor, connected in parallel to the appliance. The stopper 12 limits the maximal time interval, which is normally shorter then the pause between the pulses of the timer 1—see graph 2.

When the timer 1 closes its contact, the relay S1 accepts the electric current, and both pairs of its contacts are closed. The appliance is connected to the grid via S1-2 contact. In a short time after this, the timer contact 1 is opened. If the second (mechanical) timer 11 is not activated at this time, the relay S1 looses the current and opens its contacts, and so disconnects the appliance from the grid. If the timer 11 is activated, its switch 3 is closed, the relay S1 is connected to the current via contacts S1-1 and 3, its contacts S1-1 and S1-2 stay closed, and the appliance stays connected to the grid until the timer 11 terminates its reverse stroke, and the switch 3 opens.

If the timer 11 is of spring-driven reverse stroke, it is preferable to install thereto a stopper (not shown), preventing the timer reverse stroke when the appliance is disconnected from the grid, and so enabling the delay period counting only when the appliance is activated. With motor-driven timer, the same effect is achieved by connecting the motor in parallel to the appliance.

Figure 3:
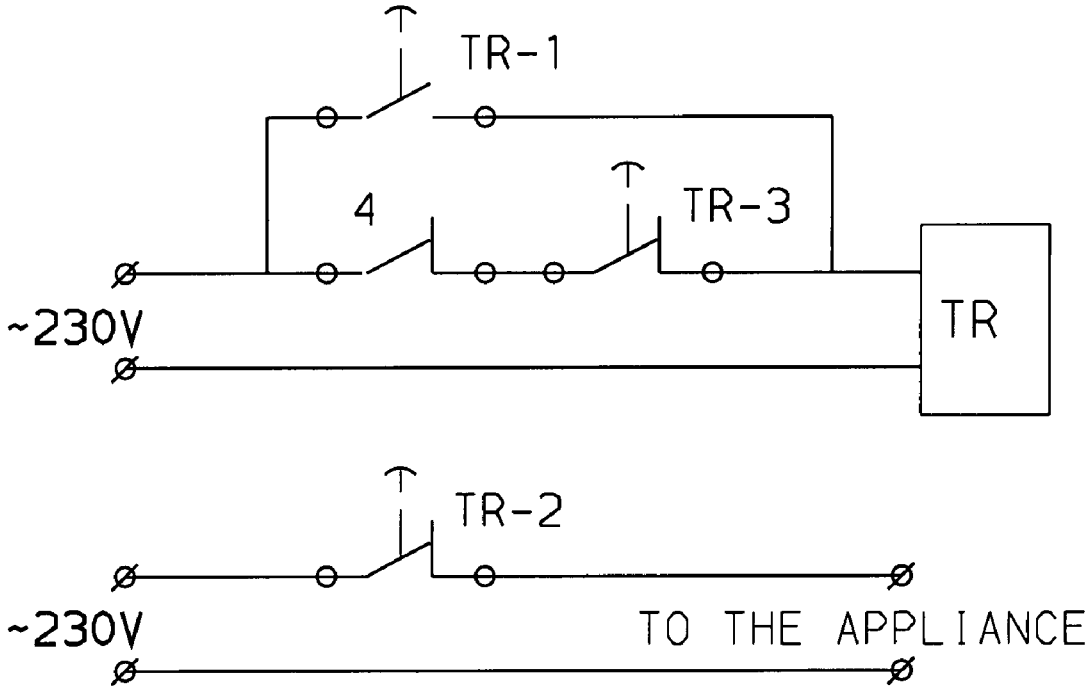
FIG. 3 is an electric scheme of the timer of the invention, activating the appliance a given time after its deactivation.
Figure 4:
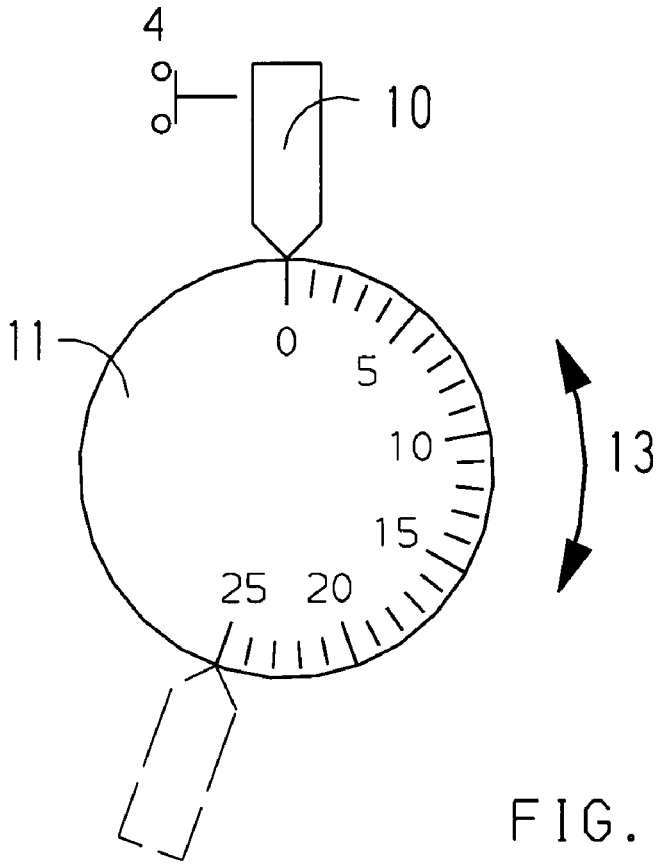
FIG. 4 is a schematic view showing a mechanical timing device of the timer shown in FIG. 3.

FIG. 3 shows an electric scheme of an alternative embodiment of the timer according to the invention. This timer also connects and disconnects an electric appliance (not shown) to the electric grid. Electromechanical or electronic timer TR has three pairs of contacts: TR-1 and TR-3 are installed at the power supply of the timer itself, and TR-2 at the power supply of the appliance. The contact TR-1 is normally open, TR-2 and TR-3 are normally closed. The mechanical timer 11 (see FIG. 4) is different from that of FIG. 2 essentially in that its switch 4 is closed when the timer 11 is not activated (the handle 10 is at "0" of the time scale). The timer TR, at the moment of its connection to the power supply, changes the position of its contacts, TR-1 to closed, TR-2 and TR-3 to open. Then it counts a pre-defined time period and switches them back to their initial positions. At this moment, the appliance is connected to the grid. If the timer 11 is not activated, with its switch 4 closed, the timer TR continues to be connected to the power supply, and in a short time begins a new cycle, changing the position of its contacts and disconnecting the appliance.

If at the time of switching the contacts TR-1, TR-2 and TR-3 to their initial positions the timer 11 is activated, with its switch 4 open, the timer TR looses its power supply. The appliance stays connected and the timer 11 counts the time until the handle 10 comes to "0" of the time scale, the switch 4 is closed and the timer TR is connected to the power supply. Then a new cycle begins.

Figure 5:
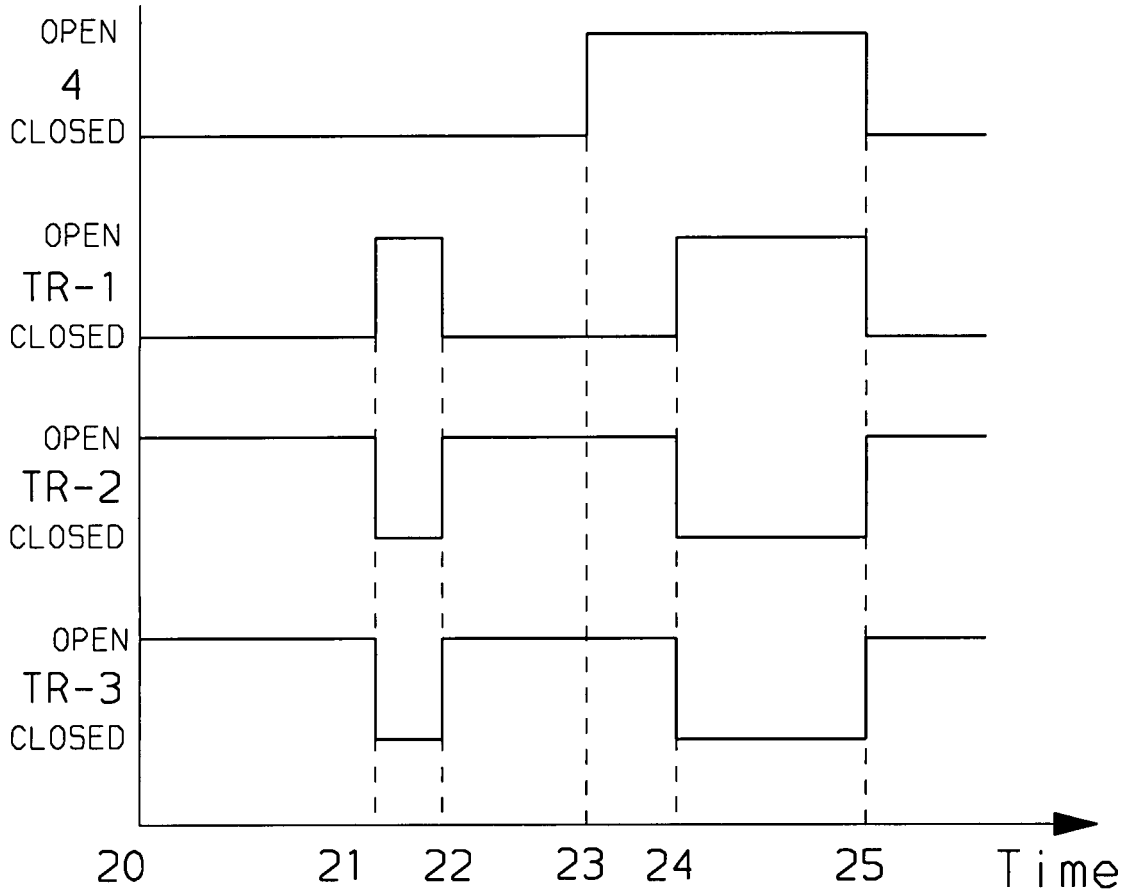
FIG. 5 shows a graph of contacts' position vs. time for the timer of FIG. 3.

FIG. 5 is an example graph of the contacts' position at the time axis for the timer of FIG. 3. At the time point 20, the timer TR is activated (connected to the power supply). Its contacts TR-2 and TR-3 become open, and TR-1 becomes closed. The timer 11 is not activated at this moment, and its switch 4 is closed. In a pre-defined time period (time point 21), when the switch 4 is still closed, the timer TR inverts the positions of all its contacts for a short time, till time point 22, and begins a new cycle of counting the pre-defined time period. The appliance is activated for this short period 21-22. At the time point 23, the timer 11 is manually activated with its switch 4 opened. It changes nothing until the time counting of the timer TR is finished at the time point 24. Here, the timer TR, like at the point 21, inverts the positions of all its contacts, the appliance is activated, and the timer 11 proceeds its time counting (reverse stroke). The timer TR looses its power supply until the timer 11 finishes its time counting and closes its switch 4 at the time point 25. All this time the appliance is activated. Closing the switch 4 returns the power supply to the timer TR, and the process begins like in a time point 20.

Figure 6:
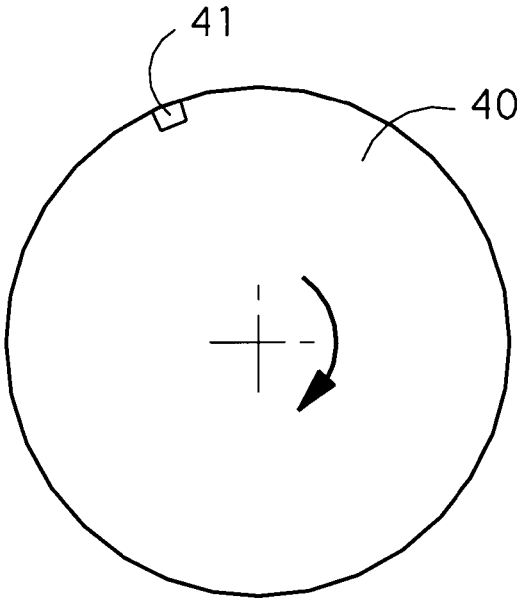
FIG. 6 is a schematic view showing an electromechanical version of the first timing device of the timer of FIG. 1.
Figure 7:
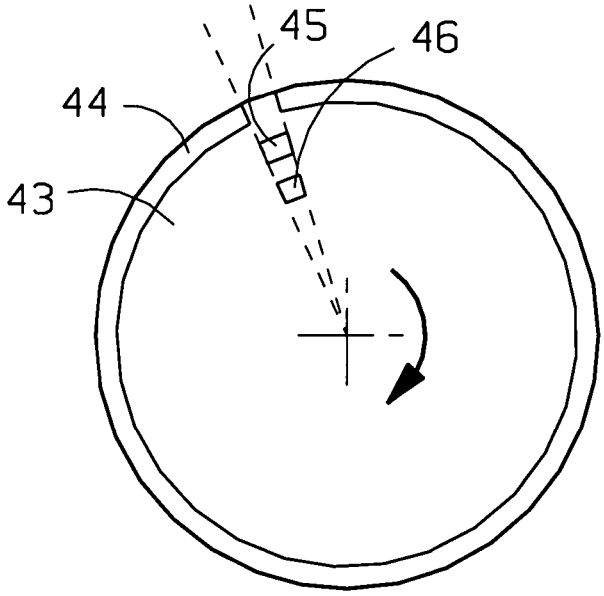
FIG. 7 is a schematic view showing an electromechanical version of the first timing device of the timer of FIG. 3.

There is a wide choice of timers, which can be used as the first timing device 1 or TR. As an example of an electromechanical version of these timers, in FIGS. 6, 7 two discs are represented, each one having electric contact surfaces, working against fixed opposite contacts. Each disc is rotated by an electric motor, while the timer receives its power supply. The disc 40 at FIG. 6 corresponds to the timer 1 of FIG. 1, and the contact surface 41 corresponds to its contact. The motor, rotating the disc 40, works continuously. The disc 43 at FIG. 7 corresponds to the timer TR of FIG. 3, and the contact surfaces 44, 45, 46 correspond to its contacts TR-1, TR-2 and TR-3, respectively. The motor, rotating the disc 43, stops when the timer looses its electrical supply (see explanation to FIG. 3).

Figure 8:
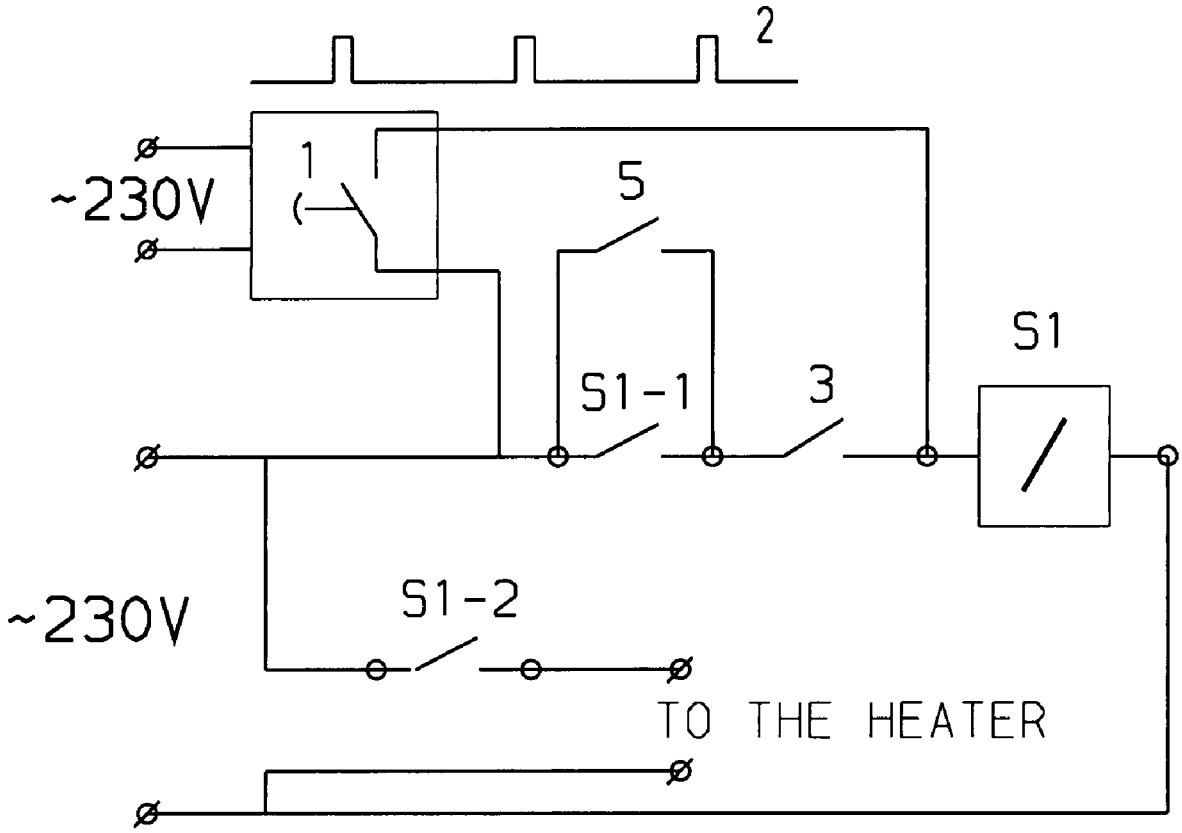
FIG. 8 is an electric scheme of an electric oven, having a built-in timer of the invention and a switch, switching the operation between secular and Saturday modes.

FIG. 8 shows a simplified electric scheme of an electric oven with the timer according to the invention built in. When the switch 5 is open, the scheme is equivalent to that at FIG. 1, and the appliance works at Saturday mode. Closing the switch 5, together with disconnecting the timer 1 from the power supply (not shown), shortens the contact S1-1 and moves the control to the mechanical timer 11, which is a secular control mode.

It will be appreciated that the both timing devices may be of different kinds, and the electric scheme should be suited to these timers, without departing from the scope of the invention as defined in the appended claims.

The invention claimed is:

1. A timer for operating electric appliances at Saturday and Holyday in accordance to Jewish law, activating the appliance and deactivating it, the timer comprising:

a first timing device, automatically operating, activating and deactivating the appliance from time to time, and a second timing device, manually activated, which, when activated, delays at least the nearest appliance deactivation by the first timing device.

2. The timer according to claim 1, in which the first timing device activates the appliance at pre-defined times.

3. The timer according to claim 2, in which the maximal appliance deactivation delay by the second timing device is shorter then the time period between the appliance activations by the first timing device.

4. The timer according to claim 1, in which the first timing device activates the appliance activation in a given time period after the last appliance deactivation.

5. The timer according to claim 1, in which the first timing device, if the second timing device is not activated, activates the appliance for a period at least 10 times shorter then the time period between the appliance activations.

6. The timer according to claim 1, in which the second timing device is mechanical with manually driven activation stroke and spring-driven reverse stroke.

7. The timer according to claim 6, in which the second timing device includes a stopper, preventing the device reverse stroke while the appliance is not activated.

8. The timer according to claim 1, in which the second timing device is mechanical with manually driven activation stroke and electrical motor driven reverse stroke.

9. The timer according to claim 8, in which the motor of the second timing device is working substantially when the appliance is activated.

10. Electric appliance, comprising the timer according to claim 1 built thereto.

11. Electric appliance according to claim 10, comprising an additional control device and means for switching the control between the timer and the additional control device.

12. Electric appliance according to claim 11, in which one of the timing devices of the timer is used also by the additional control device.

* * * * *